United States Patent [19]

Sekiya et al.

[11] 4,308,607

[45] Dec. 29, 1981

[54] ELECTRONIC TIMEPIECE

[75] Inventors: Fukuo Sekiya; Minoru Watanabe, both of Tokorozawa, Japan

[73] Assignee: Citizen Watch Company Limited, Tokorozawa, Japan

[21] Appl. No.: 29,563

[22] Filed: Apr. 12, 1979

Related U.S. Application Data

[62] Division of Ser. No. 23,041, Mar. 22, 1979.

[30] Foreign Application Priority Data

Apr. 22, 1978 [JP] Japan ..... 53-48164

[51] Int. Cl.[3] ..... G04C 9/00

[52] U.S. Cl. ..... 368/187; 368/184; 368/188; 368/202

[58] Field of Search ..... 58/23 R, 85.5, 50 R, 58/34; 307/247 A; 368/184, 187, 188, 202

[56] References Cited

U.S. PATENT DOCUMENTS

| | | | |
|---|---|---|---|
| 3,871,168 | 3/1975 | Maire et al. | 58/85.5 X |
| 3,928,959 | 12/1975 | Naito | 58/85.5 X |
| 3,988,597 | 10/1976 | Yamaguchi | 58/23 R X |
| 4,030,284 | 6/1977 | Portmann | 58/85.5 X |
| 4,033,109 | 7/1977 | Takase et al. | 58/23 R X |
| 4,107,915 | 8/1978 | Sekiya et al. | 58/85.5 X |
| 4,128,991 | 12/1978 | Robert-Grandpierre | 58/85.5 X |

*Primary Examiner*—Ulysses Weldon

*Attorney, Agent, or Firm*—Holman & Stern

[57] ABSTRACT

An electronic timepiece equipped with a switch means to produce switching pulses in response to actuation of an external operation member, and means for detecting the time intervals between pairs of the switching pulses and producing first control signals indicative of duration of the time intervals. A counter circuit is responsive to the first control signals to provide a second control signal, in response to which a correction signal generation means produces correction signals, the number of which depends on the second control signal.

8 Claims, 16 Drawing Figures

Fig. 2B
Fig. 2A
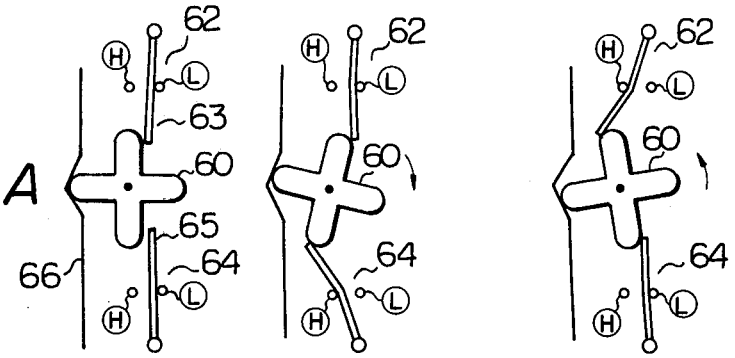
Fig. 2C
Fig. 3
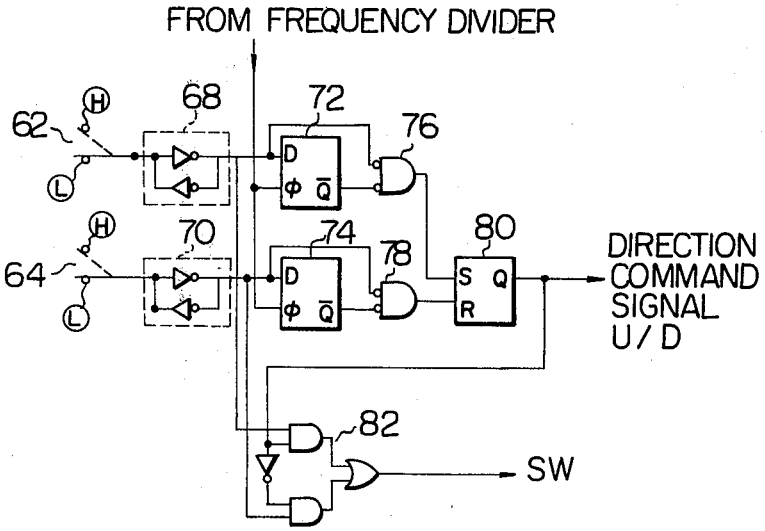

Fig. 4A
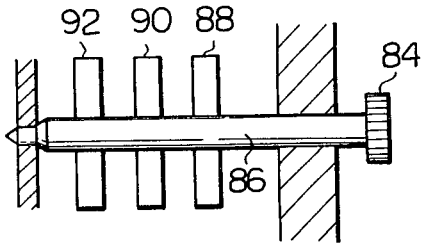
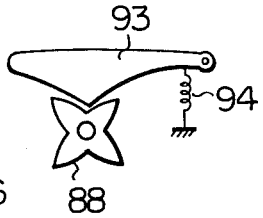
Fig. 4B
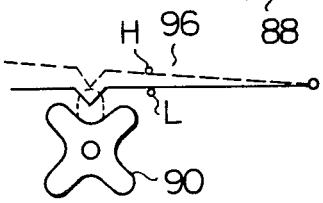
Fig. 4C
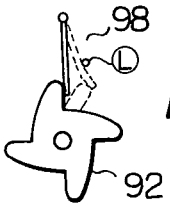
Fig. 4D
Fig. 5A
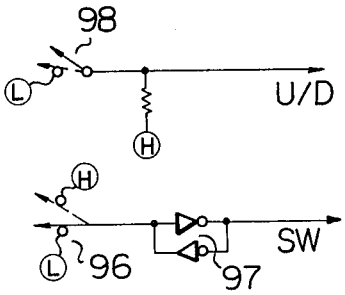
Fig. 5B

ELECTRONIC TIMEPIECE

CROSS-REFERENCE TO RELATED APPLICATIONS

This application is a divisional application of applicants' copending U.S. patent application Ser. No. 23,041, entitled "ELECTRONIC TIMEPIECE", filed Mar. 22, 1979.

This invention relates to electronic timepiece, and in particular to an electronic timepiece equipped with a rotatable operating member such as a crown, which is actuated in order to perform such functions as correction of the displayed time information.

Conventionally, electronic timepieces having time indicating hands have generally been adjustable for time correction by means of a rotatable crown, in a similar manner to a mechanical type of timepiece. This method has the disadvantage of introducing a certain degree of mechanical complexity into a device which should be, as far as possible, mechanically simple. In the case of digital display type electronic timepieces, on the other hand, time correction is generally performed by actuation of one or more pushbutton type switches. Actuation of one of these switches causes the time displayed by the timepiece to be rapidly advanced, i.e. unidirectional type of time correction only can be performed. This can result in time correction being slightly time-consuming, as in cases when it is necessary to advance the displayed time by about 59 minutes, for example. A bidirectional method of time correction would be preferable. However this is likely to involve a greater number of operating members being required, or to cause operation of the correction switch to become more complex, and has not yet been adopted. Another type of electronic timepiece has recently been developed in which both a digital display of time and a time display by means of indicating hands are provided. With such a timepiece, it is preferable to provide a conventional form of time correction, i.e. by means of a rotatable crown, which can be used to correct both the digital and the time indicating hands displays simultaneously. Such a method of time correction has hitherto been difficult to achieve in a simple and easily manufactured form.

It is therefore an object of the present invention to provide an improved system of time correction in an electronic timepiece. More specifically, it is an object of the present invention to provide a correction signal generation system for an electronic timepiece in which the number of correction signals to be produced depends on the time interval between switching signals produced in response to actuation of an external actuation member.

Further objects, features and advantages of the present invention will be made more apparent by the following specification, when taken in conjunction with the attached drawings, whose scope is given by the appended claims.

In the drawings:

FIGS. 2A, 2B and 2C illustrate a switch section of an electronic timepiece according to the present invention, coupled to a rotatable operating member;

FIG. 3 shows an input circuit for the switch section of FIGS. 2A to 2C, for producing signals indicative of the direction and speed of rotation of the rotatable operating member;

FIGS. 4A, 4B, 4C and 4D illustrate another embodiment of a switch section applicable to an electronic timepiece according to the present invention;

FIGS. 5A and 5B show input circuits for the switch section of FIGS. 4A to 4D, to provide signals indicative of the direction and rate of rotation of the operating member;

Figure 1A:
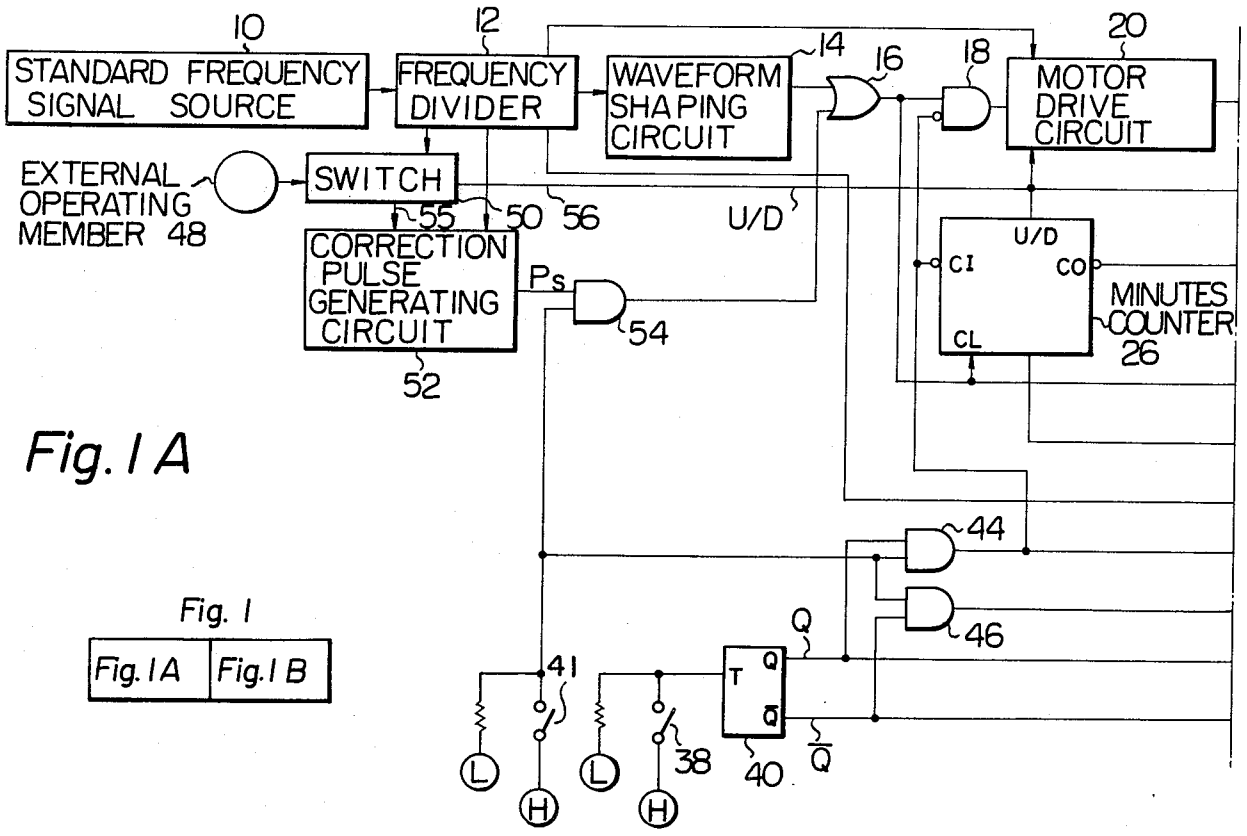
FIG. 1 (FIG. 1A and FIG. 1B) is a block diagram of an electronic timepiece according to the present invention.

Referring now to FIG. 1, a block diagram of an embodiment of an electronic timepiece according to the present invention is shown therein. A standard frequency signal source 10 produces a signal of relatively high frequency, which is applied to a frequency divider circuit 12. An output signal from frequency divider 12 having a period of one minute is applied to a waveform shaping circuit 14, the output of which is input to an OR gate 16. The output of OR gate 16 is applied through an inhibit-AND gate 18 to a motor drive circuit 20. Motor drive circuit 20 drives a timepiece motor 22, which is coupled to time indicating hands of an analog type time display 24, thereby causing the minutes hand of display 24 to be advanced once per minute. By suitable control of the operation of drive circuit 20, as described hereinafter, motor 22 can be caused to rotate in either a forward (i.e. normal) direction, or in a reverse direction.

A digital timekeeping section is composed of counters 26, 28, 34, and 36, each of which is a reversible counter, referred to hereinafter as an up/down type counter, and OR and inhibit-AND gates 30 and 32. The up/down counters can be of such a type as the DC4029 manufactured by RCA company. These have an up/down counting control terminal, designated U/D in FIG. 1, and count input, count output and clock terminals which are designated by CI, CO and CL respectively in FIG. 1. During normal timekeeping, a low logic level potential (abbreviated hereinafter to L level) is applied to the CI terminal, which is an inverting input. Thus, counter 26, which is a scale-of 60 counter, counts up the minutes of time during normal timekeeping. The CO output of minutes counter 26 is coupled to the CI input of an hours counter 28, the CO, output of which is applied through an inverting input terminal of OR gate 30 to AND gate 32. The inverting input of AND gate 32 is normally at the L potential, so that the output of OR gate 30 is applied to the CI input of the days counter 34. The CO output of the days counter 34 is applied to the CI input of months counter 36.

Numeral 38 denotes a switch coupled to an external actuating member, which is used to change over between the display of the current time and the display of the date. Each time switch 38 is actuated, the outputs Q and $\overline{Q}$ of a toggle-type flip-flop 40 change state. When the $\overline{Q}$ output of flip-flop 40 is at the high logic level (referred to hereinafter as the H level), then gate circuits 42 and 44 are enabled to apply the contents of the minutes and hours counters 26 and 28 to a display decoder/driver circuit 46. If switch 38 is now actuated, causing the $\overline{Q}$ signal from flip-flop 40 to go to the L level and the Q signal to go to the H level, then gate circuits 42 and 44 are enabled to apply the contents of the days and months counters 34 and 36 to the display decoder/driver circuit 46, to be indicated on a display 48 as shown in FIG. 1.

Since the same standard time signal, with a period of one minute, is applied to motor driver 20 and to timekeeping counters 26 to 36, the time information supplied to the time indicating hands of display 24 and to digital display 49 is advanced synchronously. Thus, it is only necessary to make the time displayed by analog display 24 and digital display 49 identical at the time of applying power to the timepiece circuit, i.e. when a battery is inserted into the timepiece. Thereafter, analog display 24 and digital display 49 will indicate identical time information. It is therefore possible to modify the timepiece embodiment of FIG. 1 so that only the months and days information is indicated on digital display 49, while the hours and minutes information is indicated on analog display 24.

Numeral 48 indicates a rotatable operating member which is coupled to a switch 50. Rotation of operating member 48 causes switch 50 to be actuated, causing a switching signal comprising a first pulse train to be produced on line 55 and a direction command signal indicative of the direction of rotation of operating member 48 to be produced on line 56. The signal on line 55 is applied to a correction pulse generation circuit 52, which produces a correction signal PS comprising a second pulse train. The direction command signal on line 56 is applied to a control terminal of motor driver 20 and to up/down count control terminals of counters 26, 28, 34 and 36. When the direction command signal is at one logic level potential, then counters 26, 28, 34 and 36 count in normal, i.e. up direction, while the output signal from motor driver 20 in response to an input signal applied from gate 18 causes motor 22 to advance in the forward direction. When the direction command signal is at the other logic level potential, then counters 26, 28, 34 and 36 count in the opposite, i.e. down direction, while motor driver 20 produces an output which causes motor 22 to rotate in the reverse direction, in response to an input signal applied from gate 18.

Numeral 41 denotes a switch which is actuated by an external operating member. When switch 41 is in the non-actuated state, i.e. producing an L level output, then correction pulses Ps are inhibited from passing through an AND gate 54. When switch 41 is actuated, to produce an H level output, then AND gate 54 is enabled to pass correction pulses PS to a input of OR gate 16, and thereby to the clock terminals of counters 26, 28, 34 and 36, and to the input of motor driver 20 through gate 18. Switch 41 thus serves to set the timepiece selectively into a correctable or a non-correctable operating state. If the $\overline{Q}$ output of flip-flop 40 is at the H level when the timepiece is set in the correctable state, then the output of AND gate 46 goes to the H level. Gate 32 is thus inhibited from passing the output signal from the CO terminal of hours counter 28 to the days counter 34. In this operating condition therefore, correction signals PS resulting from rotation of operating member 48 are applied to the clock terminals of minutes and hours counters 26 and 28 causing correction of the contents thereof, and the results of this correction are visible on the digital display 49. Simultaneously, the hours and minutes displayed on analog display 24 are corrected by the same amount as those of the digital display 49. Since the input to the CI terminal of days counter 34 is held at the H logic level by the output of gate 32, the contents of the days and months counters 34 and 36 are not affected by correction of the contents of the hours and minutes counters 28 and 26.

If switch 38 is now actuated, causing the Q output of flip-flop 40 to go to the H logic level, then the output of AND gate 44 will go to the H level while that of AND gate 46 will go to the L level. The H level output of flip-flop 40 causes gate 18 to be inhibited from passing correction pulses PS, appearing at the output of OR gate 16 when operating member 48 is actuated, to the motor drive circuit 20. Thus, the time indicating hands of analog display 24 are not affected by the correction pulses Ps. At the same time, the H level output of flip-flop 44 is applied to the CI terminal of minutes counter 26, thereby preventing this counter from counting in response to the Ps pulses applied to its clock terminal. Thus, in this operating condition, the contents of the hours and minutes counters 28 and 26 are not affected by the correction pulses. The H level output of flip-flop 44 also appears at the output of OR gate 30, causing gate 32 to produce a low level output (since an L level input is applied to the inverting input terminal of gate 32). The days and months counters 34 and 36 therefore count in response to the Ps correction pulses applied to their clock terminals. Since the timepiece is now in the date display condition, the results of correction are visible on the digital display 49.

Figure 1B:
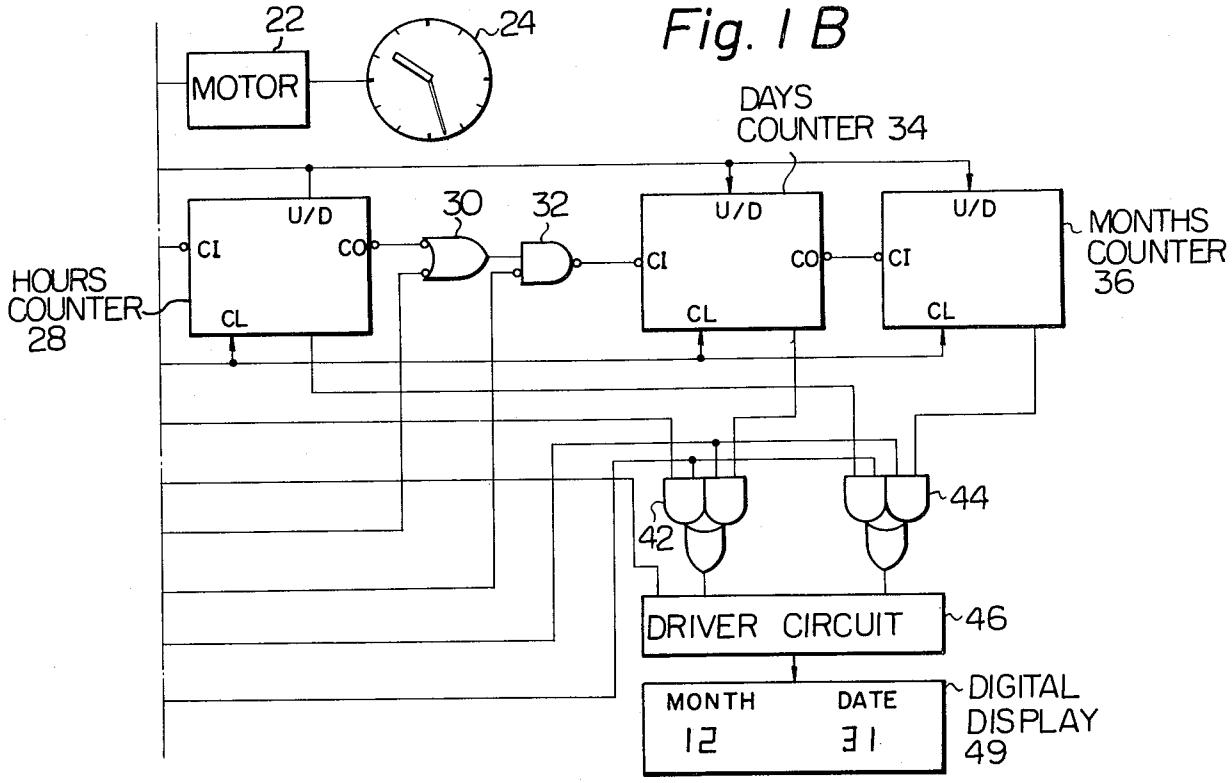

Thus, with the timepiece circuit of FIGS. 1A and 1B, the minutes and hours can be corrected independantly of the day and month, and correction of the hours and minutes indicated by the hands of analog display 24 and of the hours and minutes indicated by digital display 49 are conducted simultaneously. In addition, depending upon the direction in which operating member 48 is rotated, a direction command signal is produced which causes correction to be performed in either a forward or a reverse direction, both for the analog display 24 and for the digital display 40. By this embodiment of the present invention, therefore, time correction can be conducted by utilizing a timepiece crown in the same manner as for a conventional type of mechanical timepiece. Since the control of the direction in which correction is performed is conducted by nonmechanical means, the mechanical components associated with the timepiece crown can be extremely simple and few in number, as will be exemplified hereinafter. Thus, the mechanical structure of an electronic timepiece in accordance with the present invention can be considerably simplified by comparison with previous designs of such timepieces which utilize a crown for correction of time information.

Referring now to FIGS. 2A, 2B and 2C an example is shown therein of an embodiment of switch section 50 of the embodiment of FIG. 1. Numeral 60 denotes a gearwheel having four teeth, which is fixed to a timepiece crown and can be rotated thereby. A spring 66 is shaped and positioned in such a way as to hold gear wheel 60 stationary in one of four different positions when the timepiece crown is not being rotated manually. Numeral 62 denotes a first switch and numeral 64 denotes a second switch. Each of switches 62 and 64 is of changeover type, in which a resilient movable contact is normally held against a terminal connected to the L level potential, but can be forced into contact with an H level potential terminal by the action of the teeth of gear wheel 60. When gearwheel 60 is in a stationary state, as shown in FIG. 2A, then both movable contacts 63 and 65 are at the L potential level. When gearwheel 60 is rotated in a clockwise direction, as shown in FIG. 2B, then movable contact 65 of switch 64 is forced into contact with the H level terminal four times per revolution of gearwheel 60. Thus, four pulses are produced by switch 64 per revolution of the timepiece crown, in this case. When gearwheel 60 is rotated in a counterclockwise direction, as shown in FIG. 2C, then movable contact 63 of switch 62 is forced into contact with the H level terminal four times per revolution of gearwheel 60, so that again four pulses are produced per revolution of the crown.

FIG. 3 shows a circuit for obtaining a switching signal, comprising a train of pulses produced when the timepiece crown is rotated, and direction command signal, indicating the direction in which the crown is being rotated. The circuit of FIG. 3 is designed to receive switching signals produced by switches 62 and 64 shown in FIGS. 2A to 2C as input signals. Numerals 68 and 70 denote input circuits coupled to receive the outputs of switches 62 and 64 respectively, to suppress spurious pulses produced by switch bounce. Each of input circuits 68 and 70 consists of a pair of inverters, connected back-to back. The outputs of input circuits 68 and 70 are coupled to the data terminals of data-type flip-flops 72 and 74 respectively, and a relatively high frequency signal from frequency divider 12 is applied to the clock terminals of flip-flops 72 and 74. The output of input circuit 68 is also applied to an inverting input of an AND gate 76, while the $\overline{Q}$ output of flip-flop 72 is applied to the other inverting input of AND gate 76. As a result, a short duration pulse appears at the output of AND gate 76 upon each transition of the signal from switch 62 from the L level to the H level. In a similar manner, the output of input circuit 70 and the $\overline{Q}$ output of flip-flop 74 are applied to inputs of gate 78, so that the output of gate 78 produces a short duration pulse when the switching signal from switch 64 goes from the L level to the H level. The outputs of gates 76 and 78 are connected to the set and reset terminals respectively of a set/reset type flip-flop 80. Thus, the Q output of flip-flop 80 goes to the H level during actuation of switch 62. When switch 64 is actuated, i.e. when the timepiece crown is rotated in the opposite direction, then the Q output of flip-flop 80 goes to the L level. The Q output of flip-flop 80 therefore can serve as a direction command signal, since it indicates the direction of rotation of the timepiece crown.

Numeral 82 denotes a selector gate circuit, which selects the output signal from switch 64 when the timepiece crown is rotated in one direction (which we may assume to be the clockwise direction in this embodiment) and the output from switch 62 when the timepiece crown is rotated in the opposite direction (which we may assume to be the counterclockwise direction). We shall designate the output from selector gate circuit 82 as switching signal SW.

Referring now to FIGS. 4A, 4B, 4C and 4D, another embodiment of a switch system coupled to a rotatable operating member such as crown is shown. Numeral 84 denotes the crown, which is attached to a shaft 86 on which are fixed gearwheels 88, 90 and 92. An axial view of gearwheel 88 is shown in FIG. 4B, together with a pivoted member 93 attached to a spring 94, which serves to hold gearwheel 88 in one of four fixed positions when the crown 84 is not being manually rotated. Gearwheel 90 is shown in axial view of FIG. 4C, together with a switch 96 which is operated by gearwheel 90. It will be apparent that four pulses will be generated by switch 96 for each full rotation of the timepiece crown, and that the switching signal produced by switch 96 will be independant of the direction of rotation of shaft 86.

Gearwheel 92 is shown in axial view in FIG. 4D, together with a switch 98 which is actuated by gearwheel 92. It will be apparent that, due to the shape of gearwheel 92, a signal will only be produced by switch 98 when the timepiece crown is rotated in the clockwise direction.

Input circuits to which switches 98 and 96 are coupled are shown at FIGS. 5A and 5B respectively. The output of switch 98 serves as a direction command signal, indicating the direction of rotation of the timepiece crown 84. The output of input circuit 97, which receives the signal produced by switch 96, corresponds to the SW switching signal produced by the circuit example of FIG. 3.

As in the case of the switches of the example in FIGS. 2A to 2C, the switches used in the example of FIGS. 4A to 4D are of changeover type, rather than of make-and break type. This helps to ensure greater reliability of operation and reduction of the effects of switch bounce when the switches are actuated very rapidly, as can occur when the timepiece crown is rotated rapidly. Such problems are much more severe in the latter case than in the case of switches which are actuated by push-buttons.

Figure 6:
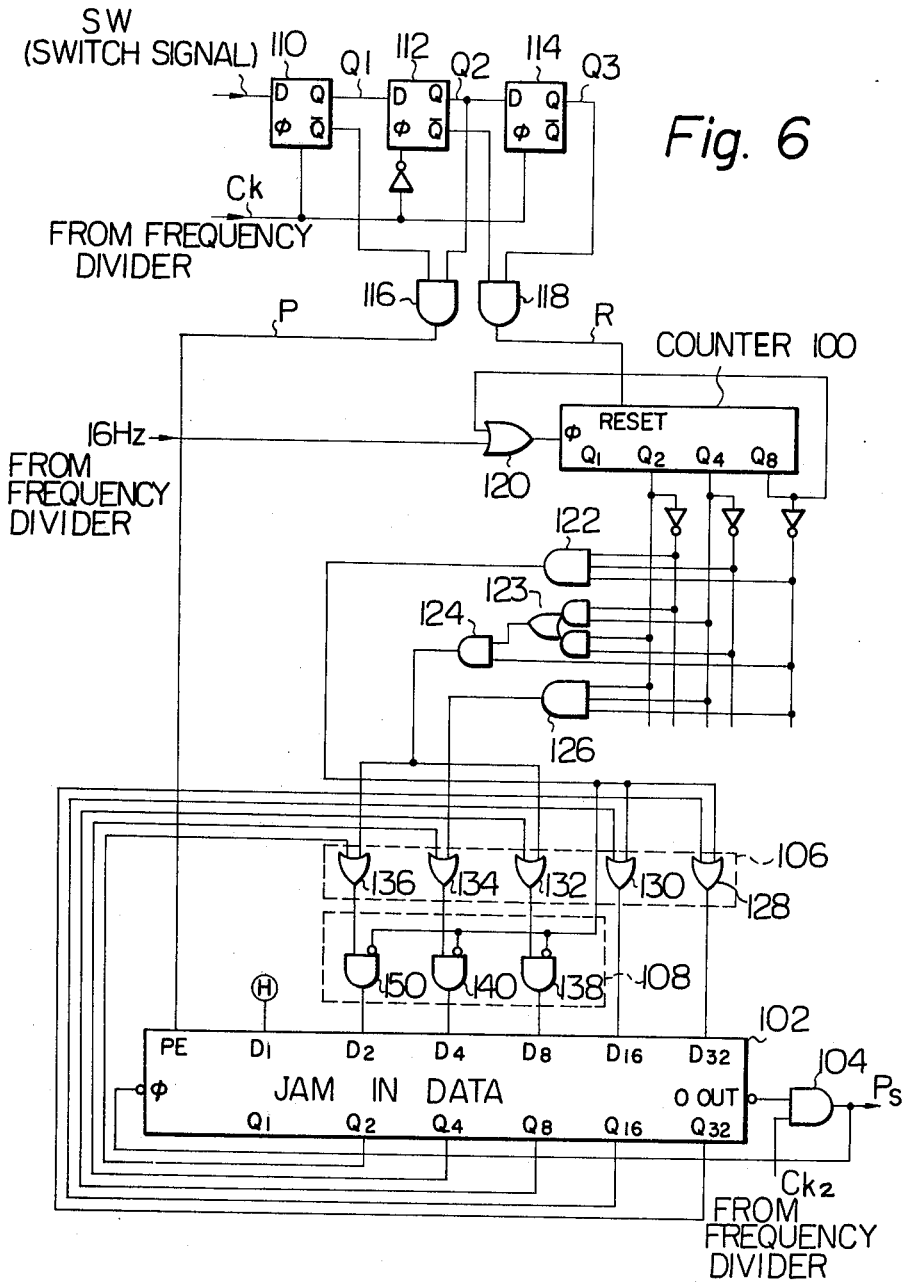
FIG. 6 is a circuit diagram of a preferred embodiment of a correction signal generation circuit according to the present invention.

Referring now to FIG. 6, an embodiment is shown therein of correction pulse generating circuit 52 shown in FIG. 1A. Switching signal SW is applied to the data terminal of a data type flip-flop 110, while a relatively high frequency signal Ck from frequency divider 12 is applied to the clock terminal of FF 110. Signal Ck is also inverted and applied to the clock terminal of a second data type flip-flop 112, and is applied directly to the clock terminal of a third data type flip-flop 114. The Q output of FF 110 is applied to the data input of FF 112, and the $\overline{Q}$ output of FF 110 is applied to an input of an AND gate 116. The $\overline{Q}$ output of FF 112 is applied to the data input of FF 114 and to a second input of AND gate 116. The Q output of FF 112 is applied to an input of an AND gate 118, while the Q output of FF 114 is applied to a second input of AND gate 118. The output of AND gate 116, designated P as an abbreviation for present, is applied to the Preset Enable (PE) terminal of a jam in type of down counter 102. The output of AND gate 118, designated as R (for reset) is applied to the reset terminal of a counter circuit 100. An output terminal Q8 of counter 100 is applied to an input of an OR gate 120, while a 16 Hz signal from frequency divider 12 is applied to another input of OR gate 120. The output of OR gate 120 is applied to the clock input terminal of counter 100. Outputs Q8, Q4 and Q2 of counter 100 are combined and applied to a set of gate circuit 122, 123, 124, and 126. These gate circuit perform encoding of the Q2, Q4 and Q8 outputs of FF 100 such that, when a count of 1 or less is held in counter 100, the output of AND gate 122 is at the H level, while if the count in counter 100 is in the range 2 to 5, the output of AND gate 124 is at the H level. If the count is 6 or 7, then the output of AND gate 126 goes to the H level, while if the count is 8, the outputs of all of the AND gates 112, 124 and 126 go to the L level. The maximum count of counter 100 is 8, since when this count is reached, the Q8 output goes to the H level, thereby preventing any further clock input pulses from being applied through OR gate 120.

The outputs of AND gates 122, 124 and 126 are combined with outputs Q2, Q4, Q8, Q16 and Q32 of down counter 102 in OR gates 128, 130, 132, 134 and 136, in OR gate block 106, for reasons which will be explained hereinafter. The output of AND gate 122 is applied to inputs of OR gates 128 and 130. The output of AND gate 124 is applied to inputs of OR gates 132 and 136. The output of AND gate 126 is applied to an input of OR gate 134. The outputs of OR gates 128 and 130 are applied to data input terminals D32 and D16 respectively of down counter 102. The output of AND gate 122 is also applied to the inhibit input terminals of a set of inhibit-AND gates 138, 140 and 150. The outputs of OR gates 132, 134 and 136 are applied to inputs of inhibit-AND gates 138, 140 and 150, respectively. The outputs of inhibit-AND gates 138, 140 and 150 are applied to data input terminals D8, D4 and D2, respectively. The D1 data input terminal of down counter 102 is held at the H level. An output terminal of down counter 102, designated as O OUT, is connected to an input of an AND gate 104. A relatively high frequency signal Ck2 is applied to a second input of AND gate 104. The output of AND gate 104, which is signal PS, is applied to the clock input terminal of down counter 102.

Figure 7:
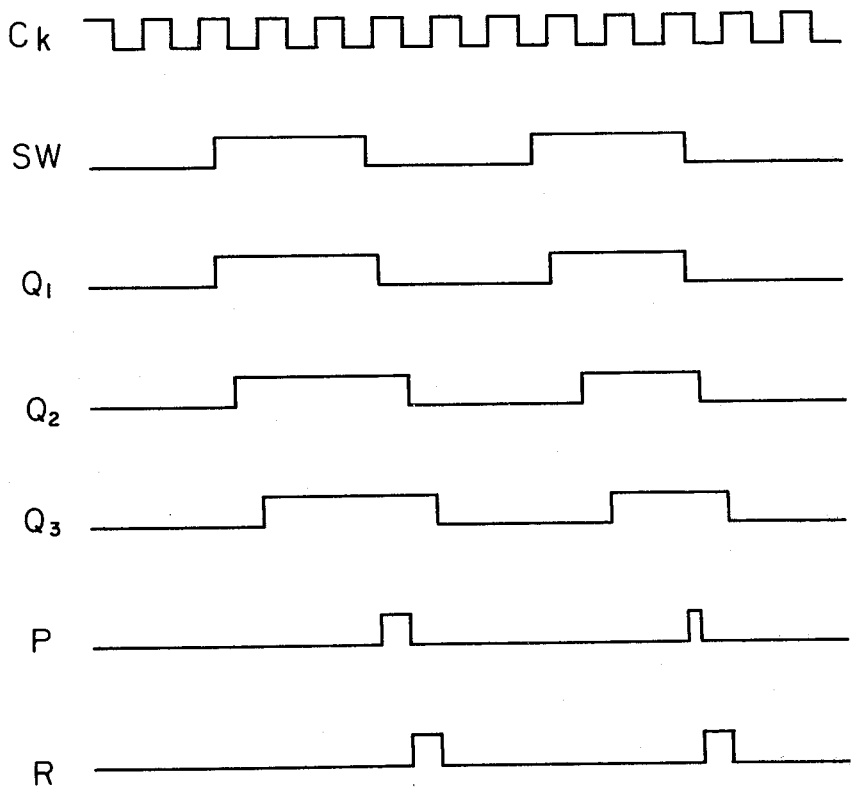
FIG. 7 is a waveform diagram illustrating the operation of the circuit of FIG. 6.

The operation of the circuit of FIG. 6 will now be described, with reference to the waveform diagram of FIG. 7, in which Q1, Q2 and Q3 indicate the output signals from FF 110, FF 112 and FF 114, respectively. As shown in FIG. 7, signals P and R occur on the negative-going edges of signals Q1 and Q2, with the period between successive R pulses being approximately equal to the period of signal SW, but synchronized with signal Ck. When an R pulse occurs, the contents of counter 100 are reset to zero, i.e. outputs Q2, Q4 and Q8 of counter 100 go to the L level. The ouput of AND gate 122 therefore goes to the H level. Thereafter, if the time between the trailing edge of that R pulse and the leading edge of the next P pulse is less than approximately 120 milliseconds (i.e. the count in counter 100 is 1 or less, when the next P pulse occurs), then only the output of AND gate 122 will be at the H level when that next P pulse occurs. If the time between the trailing edge of that R pulse and the leading edge of the next P pulse is in the range of approximately 60 to 360 milliseconds (i.e. the count in counter 100 reaches a value in the range 2 to 5), then the output of only AND gate 124 will be at the H level when the next P pulse occurs. If the time between the trailing edge of that R pulse and the leading edge of the next P pulse is in the range of approximately 300 to 480 milliseconds (i.e. the count in counter 100 reaches a value in the range 6 to 7), then only the output of AND gate 126 will be at the H level when the next P pulse occurs. If the time between the trailing edge of that R pulse and the leading edge of the next P pulse is longer than about 420 milliseconds, then the outputs of all of AND gates 122, 124 and 126 are at the L level when the next P pulse occurs.

Down counter 102 has the property that, when a pulse is applied to the preset enable (PE) terminal, then the logic levels applied to the data input terminals D1 to D32 at that time are read into counter 102, and stored as a binary number. Output terminal O OUT then goes to the L level, and remains at the L level until a number of pulses equal to the value of the store binary number has been input to the clock terminal of the counter. In the circuit embodiment shown, output O OUT is inverted before being applied to AND gate 104.

Thus, if we assume that outputs Q1 to Q32 of down counter 102 are all at the L level, then when a pulse P is applied from AND gate 116, the outputs of OR gates 128 to 136 are stored into the down counter 102, and the inverted O OUT output goes to the H level. AND gate 104 is therefore enabled to pass the clock pulses Ck2 to the clock terminal of down counter 102. When the number of output pulses from AND gate 104 has reached a value corresponding to the binary number which has been stored into down counter 102 from input terminals D1 to D2, then the inverted O OUT signal again goes to the L level, thereby inhibiting any further transfer of clock pulses. The output pulses from AND gate 104 constitute the train of correction pulses PS.

It will be apparent that, if the time intervals between successive trailing edges of signal SW is relatively short, then a relatively large value will have been counted by counter 100 before each of the P pulses is applied to down counter 102. In addition, the outputs from AND gates 122, 124 and 126 are applied to the data inputs of down counter 102 in such a way that if a relatively small number is held in counter 100 at the time of pulse P, a relatively large number will be stored in down counter 102, so that subsequently a large number of pulse PS will be produced from AND gate 104. For example, if all of outputs Q2 to Q8 of counter 100 are at the L level before a P pulse occurs, then a value of 49 will be read into down counter 102, from data input terminals D1, D16 and D32, since the outputs of AND gates 122, 124 and 126 will all be at the H level. Thus, 49 pulses will be produced as signal PS before the next P pulse occurs.

If the value of the count stored in down counter 102 were allowed to reach an excessively high value, then an excessive time would elapse after rotation of the crown is halted (i.e. after generation of switching pulses PS is ended) during which correction pulses PS would continue to be produced from AND gate 104. The maximum count which can be stored into down counter 102 is therefore limited to a value of 49. This is accomplished by means of inhibit-AND gate block 108. If the time intervals between successive SW pulses are less than about 120 milliseconds, so that all of AND gate outputs 122, 124 and 126 go to the H level, and thereby causing the outputs of all of OR gates 128 to 136 to go to the H level, the outputs of OR gates 132, 134 and 136 are inhibited from being applied to data input terminals D2, D6 and D8 of down counter 102 by the output of AND gate 122 being applied to the inhibit input terminals of inhibit-AND gates 138 to 150. Thus, the maximum value which can be stored into down counter 102 by a preset pulse P is 49.

If the time intervals between successive PS pulses are relatively long, i.e. the timepiece crown is rotated relatively slowly, then the count in counter 100 reaches a relatively high value before each of the P pulses occurs. This causes a relatively small number to be stored in down counter 102, so that the rate of generation of PS pulses is relatively low. For example, if the time intervals between successive PS pulses is more than about 420 milliseconds, then since the outputs of all of the AND gates 122, 124 and 126 are at the L level, as explained hereinabove, so that the outputs of all of the OR gates 128 to 136 go to the L level before each preset pulse P is applied to down counter 102. A value of one will therefore by stored into down counter 102 by preset pulse P, since only data input terminal D1 of that counter is at the H level. In the above description, it is assumed that all of the output terminals Q1 to Q32 of down counter 102 are at the L level when each P pulse is applied to the preset terminal. It can therefore be seen that, if the timepiece crown is rotated very slowly, then it is possible to produce single correction pulses PS. For example, using the embodiment of a switching mechanism shown in FIGS. 4A to 4D and described previously, it is possible to produce a minimum of 4 correction pulses PS for each rotation of the timepiece crown, if the crown is rotated slowly.

When the time intervals between the SW pulses are very short, i.e. when the crown is rotated rapidly, it is possible that all of the PS pulses corresponding to a binary number stored in down counter 102 by a preset pulse P will not have been applied to the clock terminal of counter 102 before the next preset pulse P arrives. For this reason, since the remaining count in down counter 102 corresponds to the combination of logic levels of output termnals Q1 to Q32 of down counter 102, the remaining count value in down counter 102 before a preset pulse occurs is added to the new count value (i.e. the new value from which down counter 102 will begin counting down when the next preset pulse P is applied) by connecting outputs Q2, Q4, Q8, Q16 and Q32 of down counter 102 to inputs of OR gates 136, 134, 132, 130 and 128 respectively, in OR gate block 106. This is necessary due to the fact that the maximum rate at which correction pulses PS can be applied to the stepping motor of the timepiece is restricted to several hundreds of Hz, due to the limitations of response speed of the motor. Thus, if the crown is rotated in a fairly rapid but slightly irregular manner, the pulses PS will still be produced at the maximum rate, by the use of OR gate block 106. It is of course also possible to perform true addition of the count value from terminals Q2 to Q32 of down counter 102 to the data from AND gates 122, 124 and 126 by means of using full adder circuits, rather than OR gates. However such extreme accuracy may not be necessary for such an application.

From the above description therefore it will be apparent that the circuit for correction pulse generation shown in FIG. 6 will produce one correction pulse PS at a time, if the intervals between successive switch pulses SW are sufficiently long, i.e. if the crown is rotated at a sufficiently slow speed. As the time intervals between switch pulse SW decrease, i.e. as the timepiece crown is rotated at a higher speed, the rate at which correction pulses PS are produced is increased. When the time interval between successive switching pulses PS falls below a certain value, the rate at which correction pulses PS are produced becomes limited to a maximum value, which is dictated by the characteristics of the stepping motor of the timepiece. The circuit of FIG. 6 therefore enables correction of time or date to be performed easily and quickly, since the desired quantity to be corrected can be increased (or decreased) in a rapid manner or in a slow and gradual manner, in accordance with the way in which the user rotates the timepiece crown.

Down counter 102, which is a type of electronic device frequently referred to as a "Jam In" counter, is available from various manufacturers in the form of an integrated circuit.

It should be noted that, although in the circuit embodiment of FIG. 6 an inhibit-AND gate block 108 is incorporated in order to limit the maximum count which can be set into down counter 102, it is also possible to utilize a circuit for down counter 102 which has a maximum count of suitable value, such as a maximum count of 50, for example.

Figure 8:
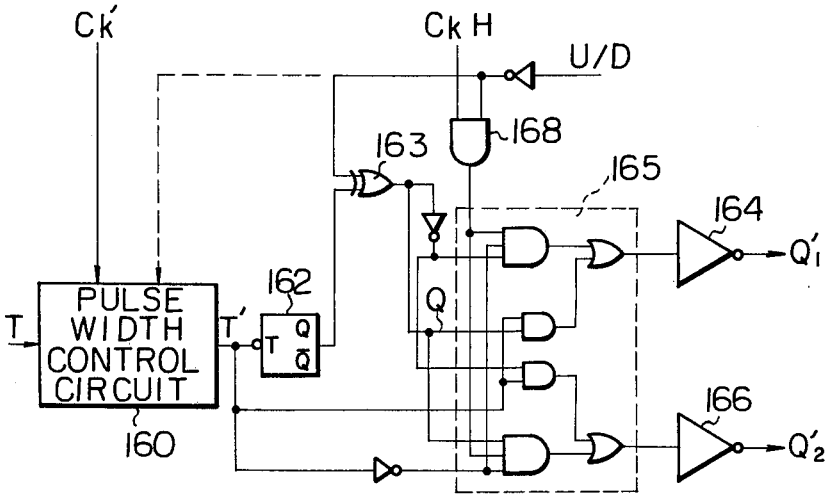
FIG. 8 is an example of a motor drive circuit for the timepiece of FIG. 1.
Figure 9:
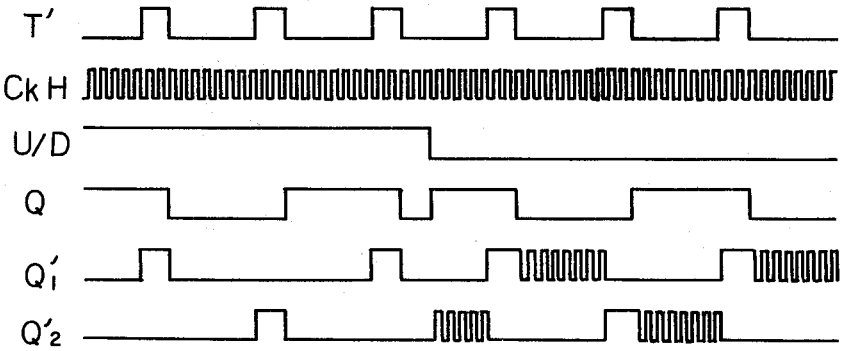
FIG. 9 is a waveform diagram for the circuit of FIG. 7.

Referring now to FIG. 8 an embodiment of motor drive circuit 20 shown in FIG. 1A is given therein. Numeral 160 denotes a pulse width control circuit. Drive input pulses T provided from the output of inhibit-AND gate 18 (shown in FIG. 1A) are applied to an input of pulse width control circuit 160, and are converted therein to a train of pulses T' having a pulse width determined by a clock signal Ck' applied to pulse width control circuit 160 from frequency divider circuit 12. Pulses T' and other circuit waveforms are shown in FIG. 9 and are applied to the toggle input terminal of a toggle-type flip-flop 162, and also are applied, in both direct and inverted form, to a gate circuit 165. The Q output of FF 162 is applied to an input of an exclusive-OR gate 163, the output of which is also applied in direct and inverted form to inputs of gate circuit 165. Signal U/D is inverted and applied to a second input of exclusive-OR gate 163, and also to one input of an AND gate 168. A clock signal CkH, of relatively high frequency, is applied to another input of AND gate 168. The output of AND gate 168 is applied to gate circuit 165. Output signal produced by gate circuit 165 are amplified by drive amplifiers 164 and 166, and then applied to stepping motor 22 as drive signals Q1' and Q2'.

The operation of this circuit can be understood by referring to the waveform diagram of FIG. 9. When signal U/D is at the H level, indicating that rotation of stepping motor 22 in the normal clockwise direction is to be performed in response to input pulses T, then the output of AND gate 168 is held at the L level by the inverted U/D signal. In this case, FF 162 causes signal Q having the waveform shown in FIG. 9 to be produced by exclusive-OR gate 163, causing gate circuit 165 to apply input signals to drive amplifiers 164 and 166 that result in single pulses Q'1 and Q'2 being alternately produced by gate circuit 165. Stepping motor 20 is thereby advanced in a direction which causes advancement of the time indicating hands of the timepiece in the clockwise direction of rotation.

When signal U/D goes to the L level, indicating that rotation of the time indicating hands in the counter-clockwise direction is to be performed, then the AND gate 168 is enabled to pass the high frequency pulses CkH to gate circuit 165. This causes the next drive output pulse Q'2 to consist of a burst of high frequency pulses, which have the effect of causing rotation of motor 22 in the direction of reverse rotation. Subsequent pulses Q'1 and Q'2 consist of a signal long pulse followed by a burst of high frequency pulses, causing motor 22 to continue to rotate in the opposite direction of rotation to the normal direction. This method of reversing the direction of rotation of a stepping motor is already known. In this way, when time correction is being performed, then when the crown is rotated in one direction, a corresponding rotation of the time indicating hands in the normal clockwise direction is accomplished, while when the crown is rotated in the opposite direction, the change in the logic level of signal U/D causes the direction of rotation of the time indicating hands to be reversed. Correction of the time indicated by the hands can thus be easily and quickly accomplished, in a similar manner to that of a conventional mechanical timepiece. In addition, correction of the time information indicated by digital display 49 is accomplished simultaneously with the correction of the time information indicated by the time indicating hands. This is due to the fact that when signal U/D is at the H level, then counters 26 and 28 shown in FIGS. 1A and 1B count in the up direction, so that the time information shown by digital display 49 is advanced. And when signal U/D is at the L level, then counters 26 and 28 count in the down direction in response to the correction pulses applied from OR gate 16, so that the time information shown by digital display 49 is retarded. Simultaneous correction of both analog and digital time information can thus be easily and rapidly performed.

In the embodiment of the present invention described above, the direction indicating signal produced by rotation of the timepiece crown is used to determined whether correction of time information will be performed in a forward or in a reverse direction. However it is equally possible to utilize such a direction indicating signal to select whether correction of time or date information is performed, or to select whether hours or minutes information is to be corrected, in the case of a digital display type of electronic timepiece.

Thus, although the present invention has been shown and described with respect to particular embodiments, various chages and modifications to these embodiments are possible, which come within the scope claimed for the present invention.

What is claimed is:

1. A correction signal generation circuit for an electronic timepiece having a source of clock pulses, comprising:

switch means coupled to an external actuation member, for producing switching pulses in response to actuation of said external actuation member;

detection means for detecting the time intervals between pairs of said switching pulses and for producing detection signals indicative of durations of said time intervals;

output signals generation means responsive to said detection signals for generating output signals indicative of a numeric value; and means for producing correction pulses in response to said clock pulses and said output signals, with the number of said correction pulses depending on said output signals;

said correction pulse producing means comprising a counter circuit for counting the number of said correction pulses to produce a control signal, and gate means responsive to said control signal and said clock pulses to produce said correction pulses.

2. A correction signal generation circuit according to claim 1, wherein said detection means comprises:

counter circuit means for counting said clock pulses, said counter circuit means being responsive to said switching pulses for being set to an initial count immediately following a transition of each of said switching pulses between a first potential and a second potential; and in which said output signals generation means comprises gate circuit means coupled to said detection means for producing said output signals indicative of said numeric value, said numeric value varying with respect to said count in said counter circuit means.

3. A correction signal generation circuit according to claim 1, in which said counter circuit comprises down counter circuit which has data input terminals coupled to receive said output signals and a clock input terminal coupled to receive said correction pulses.

4. A correction signal generation circuit according to claim 3, in which said down counter circuit also has a preset enable control terminal, and in which said detection means also has a reset terminal, and further comprising circuit means for generating a preset pulse to be applied to said preset enable control terminal of said down counter circuit upon a transition between a first potential and a second potential of each of said switching pulses, and a reset pulse to be applied to said reset terminal of said detection means.

5. A correction signal generation circuit according to claim 4, wherein said circuit means for generating said preset pulse and said reset pulse, comprises:

a first data-type flip-flop having a data input terminal coupled to receive said switching pulses to provide a first output signal;

a second data-type flip-flop having a data input terminal coupled to receive said first output signal to provide a second output signal;

first gate means responsive to an inverted first output signal from said first data-type flip-flop and said second output signal from said second data-type flip-flop to produce said preset pulse;

third data-type flip-flop having a data input terminal coupled to receive said second output signal to provide a third output signal; and second gate means responsive to an inverted second output signal from said second data-type flip-flop and said third output signal from said third data-type flip-flop to produce said reset pulse.

6. A correction signal generation circuit according to claim 1, in which said counter circuit produces a plurality of outputs, and further comprising gate circuit means responsive to said output signals and said plurality of outputs indicative of the value of a count held in said counter circuit, whereby said numeric value is added to said count held in said counter circuit to produce output signals representing a sum value, and said sum value is stored in said counter circuit.

7. A correction signal generation circuit according to claim 6, wherein the values which can be stored in said counter are limited to a predetermined maximum value.

8. A correction signal generation circuit according to claim 7, further comprising inhibit gate circuit means coupled between said gate circuit means and said counter circuit to establish said predetermined maximum value whereby a part of said output signals from said gate circuit means act to inhibit input of another part of said output signals from said gate circuit means from being applied to said counter circuit.

* * * * *